US006508238B2

(12) United States Patent
Furuya

(10) Patent No.: US 6,508,238 B2
(45) Date of Patent: Jan. 21, 2003

(54) BREATHER SYSTEM FOR ENGINE

(75) Inventor: Akira Furuya, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/864,073

(22) Filed: May 22, 2001

(65) Prior Publication Data

US 2002/0017283 A1 Feb. 14, 2002

(30) Foreign Application Priority Data

May 23, 2000 (JP) ..... 2000-150851

(51) Int. Cl.[7] ..... F01M 9/06
(52) U.S. Cl. ..... 123/572
(58) Field of Search ..... 123/572, 573, 123/574, 41.86, 90.27

(56) References Cited

U.S. PATENT DOCUMENTS 5,542,402 A * 8/1996 Lee et al. ..... 123/573
5,706,769 A * 1/1998 Shimizu ..... 123/572
6,142,129 A * 11/2000 Hori et al. ..... 123/572
6,334,438 B1 * 1/2002 Itoh et al. ..... 123/572

FOREIGN PATENT DOCUMENTS

JP 874551 3/1996

* cited by examiner

*Primary Examiner*—Marguerite McMahon
(74) *Attorney, Agent, or Firm*—Martin A. Farber

(57) ABSTRACT

A cylinder head is provided with a gas-liquid separation chamber apart from a chain chamber. The gas-liquid separation chamber is communicated with a crank chamber via a gas inlet and the chain chamber. The gas inlet is opened in the side direction of a chain within the chain chamber, and has an inclined bottom surface. At an upper end portion of the gas-liquid separation chamber is mounted an oil flow back chamber, which has an opening to communicate with a chain chamber. A blow-by gas in the crank chamber is guided into the gas-liquid separation chamber, where an oil component is separated, and then fed into another gas-liquid separation chamber in order to separate the oil component in two steps. Thereby, the oil component in the blow-by gas can be securely separated without adding new components or causing complication in a structure of breather system of an engine.

10 Claims, 4 Drawing Sheets

BREATHER SYSTEM FOR ENGINE

BACKGROUND OF THE INVENTION

The present invention relates to a breather system for allowing a blow-by gas generated in a crank case of an engine to flow back into an intake system thereof.

In the prior art, a reciprocation type of engine has been provided with the breather system for allowing the blow-by gas to flow back into the intake system of the engine, which is generated by leaking out from a gap between a cylinder and a piston into a crank case. Generally, in the blow-by gas is included an oil mist which is generated by a lubrication of a chain. In the breather system, an oil component in the blow-by gas is separated, and then the gas without the oil component flows back into an air cleaner.

A conventional overhead camshaft engine is provided with a gas-liquid separation chamber within a rocker cover disposed on a cylinder head. The blow-by gas flows into the gas-liquid separation chamber through a chain chamber. Within the gas-liquid separation chamber, the oil component is separated, and then the blow-by gas is flowed back into the intake system through a blow-by passage which connects the rocker cover with the air cleaner.

For example, Japanese patent application laid-open publication No. Hei.8-74551 discloses a breather system which includes a circular breather chamber surrounding an outer periphery of a bearing of the crank shaft on one side wall of the crank case. This breather chamber is opened at an opposite side of a crank web of the crank shaft, wherein the crank web opens/closes an inlet of the breather chamber through operating together with reciprocation of the piston, i.e. a rotation of the crank shaft, thereby preventing a reverse-flow of the blow-by gas to ensure a breathing function thereof.

However, there was a problem that an oil component can not be sufficiently separated from the blow-by gas only by the gas-liquid separation chamber mounted in the rocker cover. Thus, there were caused problems that a consumption of oil is increased, a cleaner performance is apt to deteriorate since the air including oil mist flows into the air cleaner, and further a combustion performance of the engine also is affected thereby.

In particular, in the engine provided with a cylinder inclined in the gravitational direction, when the breather chamber is provided in the neighborhood of the crank shaft, a distance between the breather chamber and the air cleaner is too long, resulting in a bad layout thereof. In this case, caused was the problem also that pressure-loss of the blow-by gas is highly generated due to the long distance, so that a blow-by gas processing function is deteriorated.

SUMMARY OF THE INVENTION

An object of the present invention is to provide a breather system of an engine which can securely separate an oil component in a blow-by gas.

In order to achieve the above mentioned object, there is provided the breather system of the engine having a valve-operating device provided at a cylinder head side of the engine, driving members for driving the valve-operating device in synchronization with a crankshaft, and a driving member chamber for accommodating the driving member in the cylinder head, which comprises a gas-liquid separation chamber provided in the cylinder head apart from the driving member chamber and communicated with a crank chamber, wherein the gas-liquid separation chamber separates oil component in blow-by gas guided into from the crank chamber. In this case, the gas-liquid separation chamber may be formed along a cylinder axis direction of the engine.

According to the present invention, the breather system can be provided with the gas-liquid separation chamber for separating an oil component in the blow-by gas without adding new components and causing complication of the system construction since the gas-liquid separation chamber communicating with the crank chamber is formed in the cylinder head apart from the chain chamber. Therefore, caused are the effects that cost up can be avoided because of no added components, the oil component be securely separated, oil consumption be decreased, and a combustion performance of engine be improved. Further, even in the case of the inclined type of engine, the breather system can be provided with the gas-liquid separation chamber without losing an adequate layout thereof.

In addition, the breather chamber may be provided with a second driving member chamber for accommodating the driving member in a cylinder block, and a gas inlet having an opening for the second driving member chamber and communicated with the gas-liquid separation chamber. Thereby, the passage length of the gas-liquid separation chamber can be lengthened so as to improve the separation efficiency of oil component. In this case, the gas inlet may be opened in a surface in a side direction of the driving member within the second driving member chamber. Thereby, the droplets of oil splashed together with the movement of chain can be prevented from entering the gas inlet. Also, the gas inlet may include a surface inclined from an opening of a side of the gas-liquid separation chamber to an opening of a side of the second driving member chamber toward the crank chamber. Thereby, the oil separated from the blow-by gas in the gas-liquid separation chamber can easily flow down into the second driving member chamber via this inclined surface, and the flow of oil can be ensured even if the engine is inclined in the longitudinal direction of the crank shaft.

On the other hand, an upper end portion of the gas-liquid separation chamber may be provided with an oil flow back chamber having an opening thereof which communicates with the chain chamber. Thereby, even if the engine is inclined and a cylinder axis thereof is disposed in the substantially horizontal direction, the oil separated in the gas-liquid separation chamber can be guided into the oil flow back chamber, and then returned into the chain chamber through the opening. Further, the oil flow back chamber may include a surface inclined from an outer wall thereof to the opening, i.e. toward the crank chamber, so that the oil flowing into the oil flow back chamber can be guided into the opening along the surface to easily induce the oil into the chain chamber.

BRIEF DESCRIPTION OF THE DRAWINGS

These and other objects and advantages of the present invention will become clearly understood from the following description with reference to the accompanying drawings, wherein.

DETAILED DESCRIPTION OF THE PREFERRED EMBODIMENTS

An embodiment of the present invention will now be described in detail with reference to the drawings.

Figure 1:
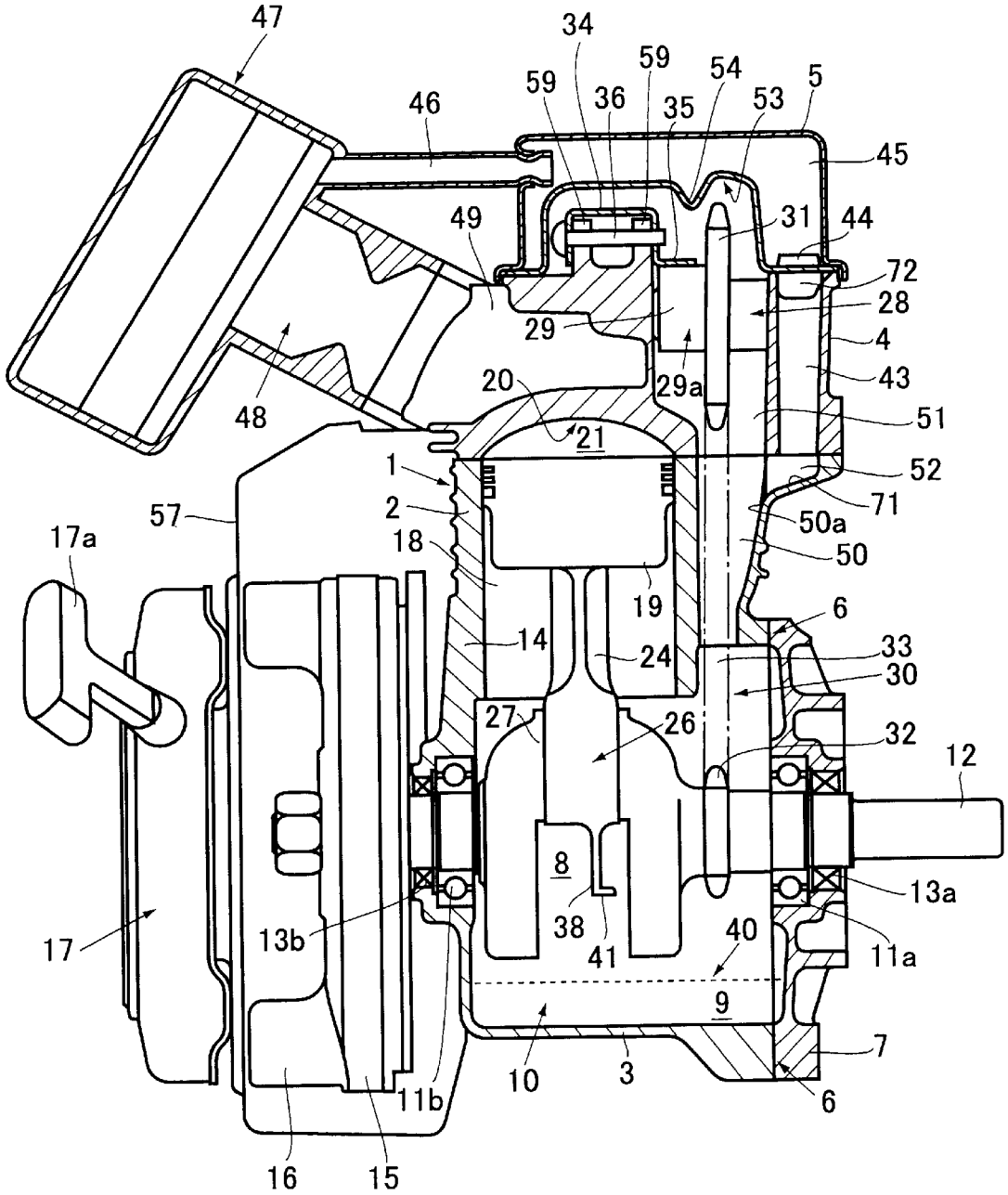
FIG. 1 is a diagram illustrating a structure of an overhead camshaft engine using a breather system according to one embodiment of the present invention.
Figure 2:
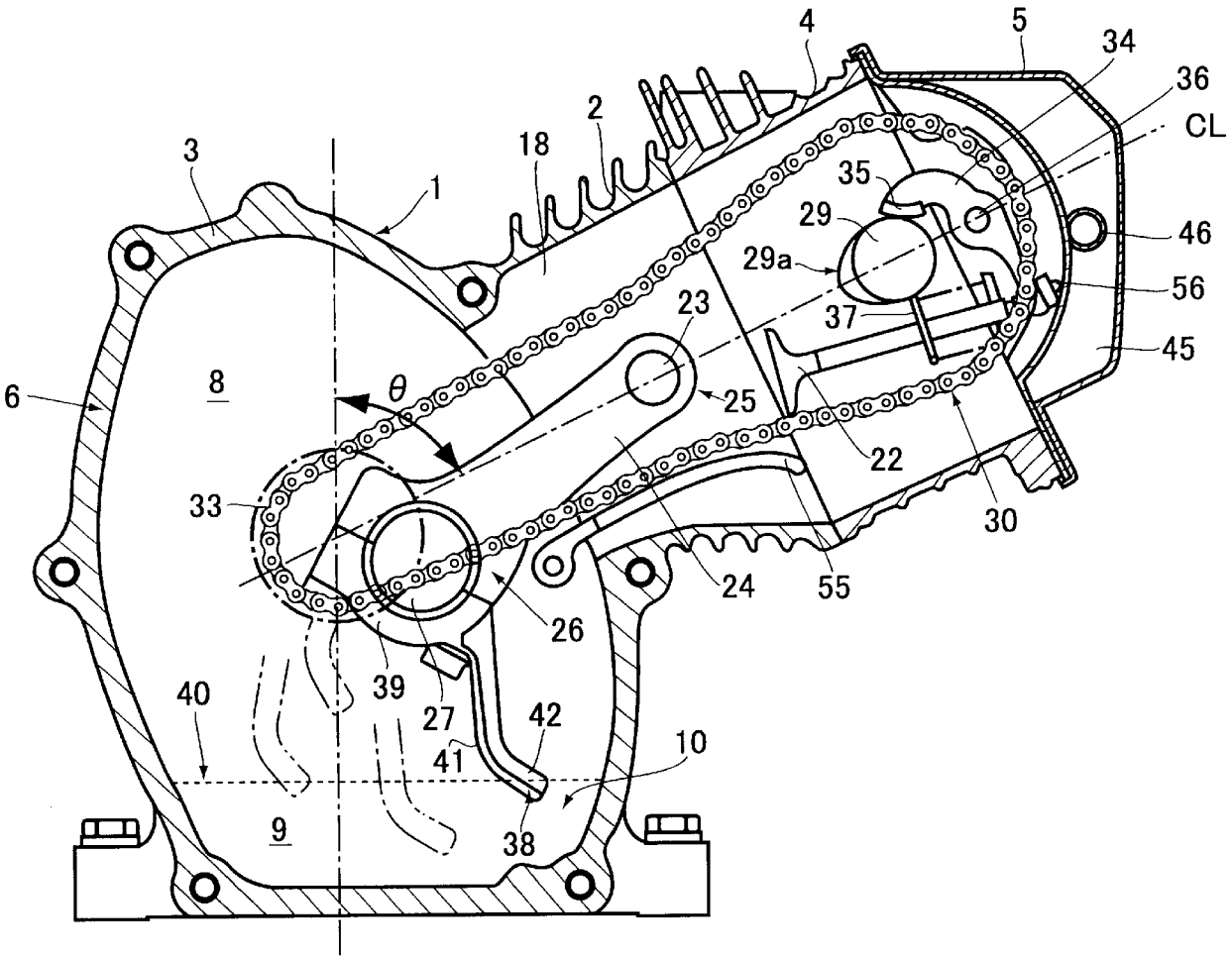
FIG. 2 is an explanatory cross-sectional view taken along with a cylinder axis of the engine of FIG. 1.

The engine of FIG. 1 is a single-cylinder 4-cycle gasoline engine, and is a so-called "inclined type of OHC engine" in which the cylinder axis CL is inclined by an angle θ with respect to the gravitational direction (see FIG. 2). In this type of engine, an engine body 1 includes a cylinder block 2 and a crank case 3 which are integrally formed with each other. The engine body 1 is made of iron or a light metal alloy such as an aluminum alloy. A cylinder head 4 made of an aluminum alloy is attached to an upper portion of the cylinder block 2. A rocker cover (cover member) 5 made of a sheet metal or a synthetic resin is mounted on a top of the cylinder head 4.

The crank case 3 has a large opening on the right side thereof in FIG. 1, thereby providing a main bearing case attachment surface 6. A main bearing case 7 made of an aluminum alloy is attached to the main bearing case attachment surface 6. Thus, a crank chamber 8 is provided in the crank case 3, and an oil pan 10 is provided under the crank chamber 8 for storing a lubricating oil (hereinafter referred to simply as "oil") 9.

A main bearing 11*a* is press-fitted into the main bearing case 7, and one end of a crankshaft 12 is supported by the main bearing 11*a*. An oil seal 13*a* is press-fitted on the outer side of the main bearing 11*a*.

A main bearing 11*b* is press-fitted into a wall surface 14 of the crank case 3 opposite to the main bearing case attachment surface 6. The other end side of the crankshaft 12 is supported by the main bearing 11*b*. Similarly, an oil seal 13*b* is provided on the outer side of the main bearing 11*b*. The oil seals 13*a* and 13*b* prevent the oil 9 stored in the oil pan 10 from leaking out of the crank case 3 along the crankshaft 12.

A flywheel 15 and a cooling fan 16 are attached to an end portion of the crankshaft 12 that extends out of the crank case 3 through the wall surface 14. The cooling fan 16 is provided outside the crank case 3 and within a casing 57, and rotates together with the crankshaft 12 so as to induce a cooling air from an outside of the casing 57. The engine body 1, the cylinder head 4, etc. are cooled by the induced cooling air. Moreover, a recoil device 17 is provided on the outer side of the casing 57. By pulling a recoil lever 17*a* by hand, the crankshaft 12 is rotated to start the engine.

A cylinder bore 18 is provided in the cylinder block 2. A piston 19 is fitted within the cylinder bore 18 so as to be slidable therein. An upper end of the cylinder bore 18 is closed by the cylinder head 4, and an upper surface of the piston 19 and a bottom wall surface 20 of the cylinder head 4 together form a combustion chamber 21. An intake valve 22, an exhaust valve (not shown), an ignition plug (not shown), etc. are provided so as to face the upper portion of the combustion chamber 21.

A small end portion 25 of a connecting rod 24 is rotatably connected to the piston 19 via a piston pin 23. A crank pin 27 of the crankshaft 12 is rotatably connected to a large end portion 26 of the connecting rod 24. Thus, the crankshaft 12 is rotated along with the vertical reciprocation of the piston 19.

A camshaft 28 is provided in the cylinder head 4 parallel to the crankshaft 12 on the cylinder axis CL. The camshaft 28 includes a valve-operating cam 29 and a sprocket 31, which are integrally formed with each other. The valve-operating cam 29 is driven in synchronization with the crankshaft 12 by a timing system 30.

A sprocket 32 is secured on the crankshaft 12. Chain chambers 50 and 51 are provided in the cylinder block 2 and the cylinder head 4, respectively, and the sprocket 31 and the sprocket 32 are connected to each other via a chain (driving member) 33 provided in the chain chambers 50 and 51. The sprockets 31, 32 and the chain 33 together form the timing system 30. The number of teeth of the sprocket 31 is twice as large as the number of teeth of the sprocket 32, so that the valve-operating cam 29 undergoes one revolution per two revolutions of the crankshaft 12. The chain 33 is provided with an appropriate tension by a chain tensioner 55.

The valve-operating cam 29 is provided with a cam surface 29*a*, and a slipper 35 formed at one end of a rocker arm 34 slidably contacts with the cam surface 29*a*. The valve-operating cam 29 and the rocker arm 34 together form a valve-operating device. Two rocker arms 34 of rocking type of are provided respectively for intaking and exhausting air. Each of the rocker arms 34 is provided so as to rock around a rocker shaft 36 which is supported by a rocker support 59. The other end of each rocker arm 34 is connected to a top end portion of the intake valve 22 or an exhaust valve (not shown) via an adjust screw 56. The intake valve 22 and the exhaust valve are each driven when the rocker arm 34 is rocked by the valve-operating cam 29. The intake valve 22 and the exhaust valve are each biased by a valve spring 37 toward the closed position. Thus, the valves are opened/closed along with the rotation of the valve-operating cam 29.

The timing system 30 is lubricated by a scraper 38 provided on the large end portion 26 of the connecting rod 24. As illustrated in FIG. 2, the scraper 38 extends downward from a lower member 39 of the large end portion 26 i.e. in a radial direction of the crankshaft 12. The scraper 38 rocks along with the rotation of the crankshaft 12 through a path as indicated by a one-dot-chain line in FIG. 2. Thus, the oil 9 stored in the oil pan 10 is dipped up by the scraper 38, and the oil 9 is splashed onto the chain 33 when the scraper 38 comes out of an oil surface 40, thereby lubricating the timing system 30.

The scraper 38, having a generally L-shaped cross section, includes a bottom wall 41 and a side wall 42 formed integrally with the bottom wall 41 and extending upward on one side of the bottom wall 41. In the present embodiment, the angle between the bottom wall 41 and the side wall 42 is set to be 90°. However, the angle therebetween is not limited to the right angle, but may be appropriately selected to the range of about 60° to about 90°.

Along with the rocking of the scraper 38, the oil 9 is dipped up by the bottom wall 41, and the oil 9 dipped up by the bottom wall 41 is guided to the side wall 42 and splashed away from the side wall 42. Thus, the droplets of the oil 9 are splashed also in three-dimensionally inclined directions, i.e. in the lateral direction from the scraper 38, thereby throwing some droplets of the oil 9 toward the root portion of the chain tensioner 55. Some of the droplets hit the inner wall of the crank case 3 and are bounced back toward the chain 33. In this way, droplets of the oil 9 can be supplied to the chain 33, which is offset toward the main bearing case 7 with respect to the scraper 38, thereby ensuring the supply of the oil 9 to the chain 33.

The oil 9 thus splashed onto the chain 33 is transferred toward the cylinder head 4 along with the movement of the chain 33, thereby lubricating the sprocket 31 also. Moreover, the sprocket 32 is also lubricated by the oil 9 attached on the chain 33.

On the side of the cylinder head 4, some of the oil 9 attached on the chain 33 is shaken off by a centrifugal force. Specifically, as a portion of the chain 33 travels around the sprocket 31, some of the oil 9 on that portion of the chain 33 is thrown off the chain 33 in the circumferential direction of the sprocket 31. In the illustrated engine, the rocker cover 5 is provided above the sprocket 31, and those droplets of the oil 9 hit the ceiling surface (ceiling portion) 53 of the rocker cover 5. The oil 9 attached onto the ceiling surface 53 runs down along the ceiling surface 53 back into the oil pan 10 via the chain chambers 51 and 50.

Furthermore, an oil dripping portion 54 having a downward convex shape are provided on one part of the ceiling surface 53 of the rocker cover 5 as shown in FIG. 1, so that the oil 9 attached onto the ceiling surface 53 drips from the oil dripping portion 54. This oil dripping portion 54 is positioned above a contacting portion between the valve-operating cam 29 and the slipper 35, thereby lubricating the contacting portion by the oil 9 dropped therefrom.

Figure 3:
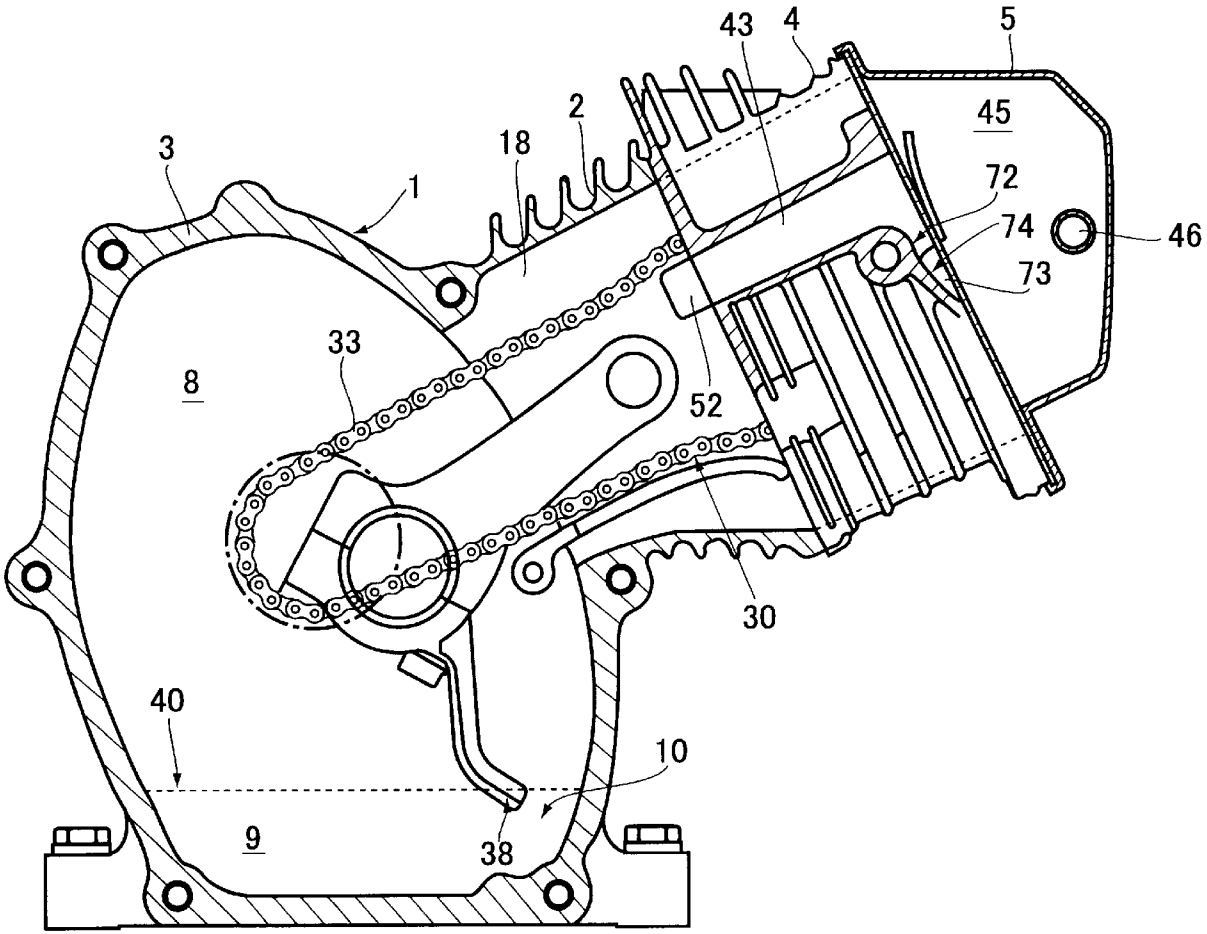
FIG. 3 is an explanatory cross-sectional view of a cylinder head taken along with a gas-liquid separation chamber in FIG. 2.

Inside the cylinder head 4, a gas-liquid separation chamber 43 is provided apart from a chain chamber (the first driving-member chamber) 51. The gas-liquid separation chamber 43 separates an oil component from a blow-by gas and operates as a breather system to allow the blow-by gas to flow back into an intake system. FIG. 3 is an explanatory view illustrating a cross section of the cylinder head 4 in FIG. 2 taken along the gas-liquid separation chamber 43. As shown in FIGS. 1, 3, the gas-liquid separation chamber 43 is formed in parallel with the chain chamber 51 along a cylinder axis CL. An upper and lower end thereof is opened to form a chamber like a tunnel. The lower end opening toward the side of the crank chamber 8 communicates with a gas inlet 52 formed in the cylinder block 2, and further with a crank chamber 8 via the both gas inlet 52 and chain chamber 50.

The gas inlet 52 is formed through branching off from the chain chamber(the second driving-member chamber) 50 at an upper end of the cylinder block 2 as shown in FIG. 1, where the gas inlet 52 is opened. Therefore, when the cylinder head 4 is mounted on the cylinder block 2, the upper end opening of the gas inlet 52 communicates with the lower end opening of the gas-liquid separation chamber.

Moreover, the gas inlet is formed on a surface 50*a* of the chain chamber 50 which is positioned in the side direction of the chain 33, i.e. in a vertical direction against an operating one of the chain 33 (the right direction of FIG. 1). Here, the oil 9 attached on the chain 33 is splashed in the longitudinal direction of the chain 33, in the other words, the radial direction of the sprockets 31, 32, but less in the side direction of the chain 33. This matter represents that the present invention substantially prevents the splashed oil from entering the gas inlet 52 through disposing the gas inlet 52 in the side direction of the chain 33.

Furthermore, referring to FIG. 1, a lower surface of the gas inlet 52 is inclined downward toward the crank chamber 8. In the other words, an inclined surface 71 is formed so as to obliquely extend from the side of the gas-liquid separation chamber 43 toward one of the chain chamber 50. Therefore, the oil 9 separated from the blow-by gas in the gas-liquid separation chamber easily flows down into the chain chamber 50 along this inclined surface. Even if the engine is inclined in the longitudinal direction of the crank shaft, that is, the right side of FIG. 1 is lowered, the flow of oil can be ensured.

Another gas-liquid separation chamber 45 is provided in the rocker cover 5 and is communicated to an upper end side of the gas-liquid separation chamber 43 via a lead valve 44. The gas-liquid separation chamber 45 is connected to an air cleaner 47 via a blow-by passage 46. The air cleaner 47 is connected to an intake port 49 in the cylinder head 4 via a carburetor 48.

At an upper end portion of the gas-liquid separation chamber 43, an oil flow back chamber 72 is provided with branching off from the gas-liquid separation chamber 43, the position of which is arranged in the right direction from the gas-liquid separation chamber 43 in the present embodiment of FIG. 2, i.e. in the right angle direction of the both cylinder axis CL and crankshaft axis 12.

Figure 4:
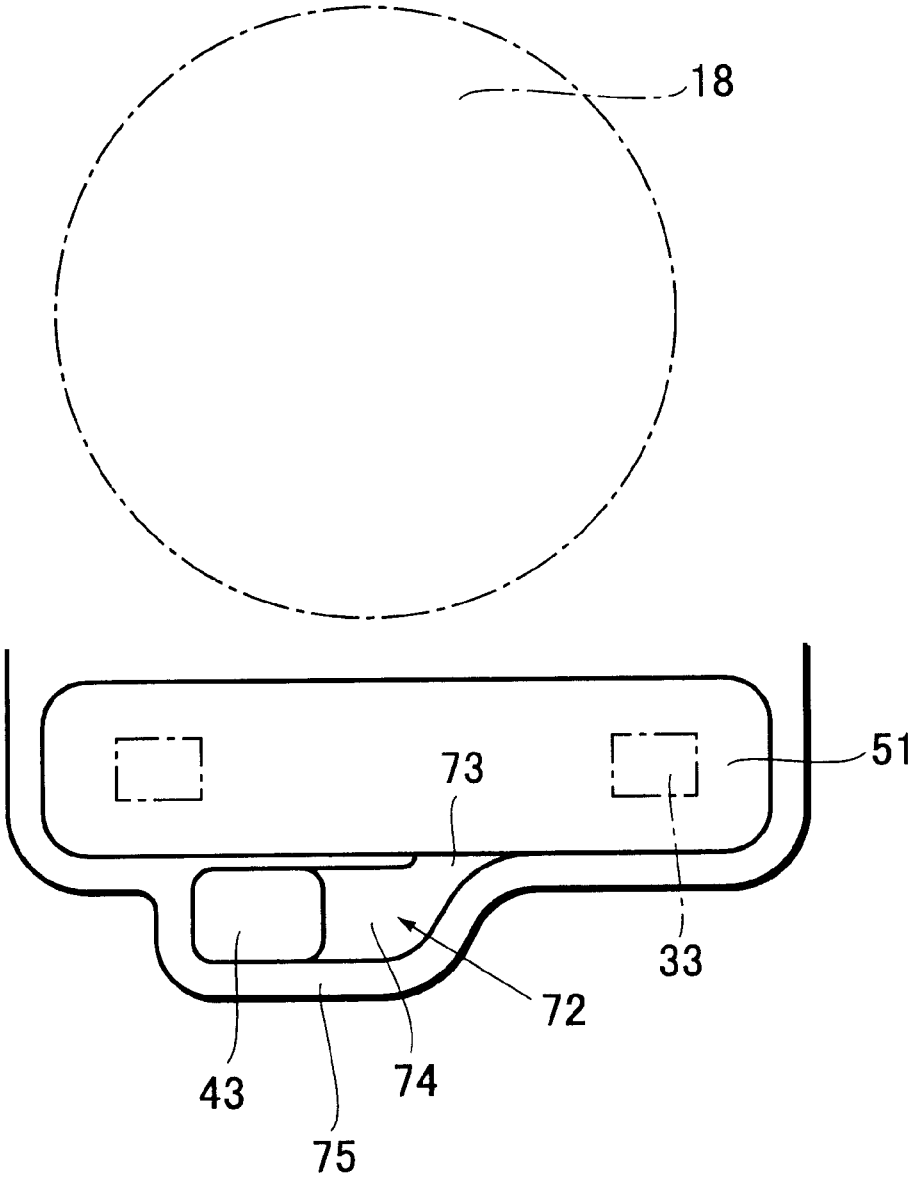
FIG. 4 is an explanatory view illustrating a structure of an oil flow back chamber of FIG. 3.

FIG. 4 is an explanatory view illustrating a structure of the oil flow back chamber 72, in which an opening 73 is formed with a communication to the chain chamber 51. A bottom surface 74 of the oil flow back chamber 72 is inclined downward from the side of an outer wall 75 toward the opening 73, i.e. to the crank chamber 8. Thus, the oil 9 entered into the oil flow back chamber 72 is guided into the opening 73 along an inclination of the bottom surface 74, and then flows into the chain chamber 51.

In the gas-liquid separation chamber 43 as mentioned above, the blow-by gas flowing from the crank chamber 8 into the chain chamber 50 then flows into the gas-liquid separation chamber 43 via the gas inlet 52. When passing through the gas-liquid separation chamber 43, an oil mist included in the blow-by gas is attached onto a wall surface of the gas-liquid separation chamber 43, thereby separating the oil mist from the blow-by gas. The oil separated in the gas-liquid separation chamber 43 flows down into the gas inlet 52. Namely, in the gas-liquid separation chamber 43, the separated oil component flows downward, whereas the gas component streams upward. As a result, the separated oil 9 returns to an oil pan 10 via a wall surface of the chain chamber 50, whereas the gas, the oil component of which is removed, is fed to the gas-liquid separation chamber 45.

The oil mist of blow-by gas flowing into the rocker cover 5 via the lead valve 44 is further separated in the gas-liquid separation chamber 45. Although the oil mist is mostly separated in the gas-liquid separation chamber 43, the remaining oil mist is separated from the blow-by gas in the gas-liquid separation chamber 45, which is attached onto a wall surface thereof.

Specifically, the breather system of the present invention separates the oil mist from the blow-by gas in the two stages, so that the oil component can be more securely separated than separation of one stage. Moreover, almost oil mist is separated before the stage of the gas-liquid separation chamber 45 which has relatively less oil separation performance, and thus a burden of the gas-liquid separation chamber 45 is reduced to cause a more effective separation as a whole.

On a lower surface side of the rocker cover 5, an oil return hole (not shown) is mounted, from which the oil component attached on the wall surface of the gas-liquid separation chamber 45 flows into the chain chamber 51, and then returned into the oil pan via the wall surfaces of chain chambers 51, 50.

According to the present invention, in the breather system can be provided the gas-liquid separation chamber 43, which can separate the oil component better without adding new components. Therefore, it becomes possible to securely separate the oil component in the blow-by gas by the breather system without causing complication of the system construction and increasing cost. Furthermore, even if the breather system with the gas-liquid separation chamber 43 is employed in an inclined type of engine, a layout of the system can be laid under the good condition.

On the other hand, as mentioned above, the breather system of the present invention includes the oil flow back chamber 72 extending downward in the gas-liquid separation chamber 43. Accordingly, even if the engine is further inclined, a cylinder axis CL of which is disposed in a substantially horizontal direction, the oil 9 separated in the gas-liquid separation chamber 43 flows into the oil flow back chamber 72, and then returned into the chain chamber 51 through the opening 73.

The present invention has been specifically described above based on a particular embodiment thereof. It is understood, however, that the present invention is not limited to the above-described embodiment, but rather various modifications can be made thereto without departing from the scope and spirit of the present invention.

For example, the gas inlet 52 may be omitted thorough providing a communication hole to communicate with the chain chamber 51 at a lower portion of the gas-liquid separation chamber 43. However, the existence of the gas inlet 52 is useful for increasing the separation efficiency because of allowing a passage length of the gas-liquid separation chamber 43 to be lengthened. Further, the cost performance also is superior since it is possible due to revising the conventional structure to provide the gas inlet 52.

Moreover, the gas-liquid separation chamber 43 need not be disposed in parallel with the cylinder bore 18 and the chain chamber 51 and provided with the same angle as the cylinder bore 18 and the chain chamber 51, respectively. That is, it may be formed with an inclination so as to lengthen the distance of the passage.

The present invention is applied to the inclined type of engine in the embodiment described above, but it is, of course, possible to apply the present invention to a normal engine in which the cylinder axis is arranged in the gravitational direction. Moreover, while the present invention is applied to an air-cooled engine with a single-cylinder in the above embodiment, the present invention may alternatively be applied to an air-cooled engine with a multi-cylinder, or a liquid-cooled engine with a single- or multi-cylinder.

While the cylinder block 2 and the crank case 3 are formed integrally with each other in the embodiment described above, these may alternatively be provided separately, and the cylinder head 4 and the cylinder block 2 may be formed integrally with each other. In addition, while the timing system 30 is provided by using the sprockets 31, 32 and the chain 33 in the embodiment described above, the timing system 30 may alternatively be provided by using other driving members known in the art, such as a cogged pulley and a cogged belt, or a timing pulley and a timing belt. Moreover, in the present invention, the term "rotation" has a general concept including a circular motion in both directions, i.e., a clockwise direction and a counterclockwise direction, not a circular motion in only one direction.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A breather system of an engine having a cylinder head, a combustion chamber and a valve-operating device provided in the cylinder head, a driving member for driving the valve-operating device in synchronization with a crankshaft, and a driving member chamber for accommodating the driving member in the cylinder head, comprising:

a gas-liquid separation chamber provided, on an external side of the combustion chamber, with the driving member chamber sandwiched between the combustion chamber and the gas-liquid separation chamber, in the cylinder head, and being apart from the driving member chamber and communicated with a crank chamber, wherein said gas-liquid separation chamber comprises a single chamber, which separates oil component in blow-by gas guided into said chamber from the crank chamber.

2. The breather system according to claim 1, wherein said gas-liquid separation chamber is formed along a cylinder axis direction of the engine.

3. The breather system according to claim 1, further comprising:

a second driving member chamber for accommodating the driving member in a cylinder block; and a gas inlet having an opening for the second driving member chamber and communicated with said gas-liquid separation chamber.

4. The breather system according to claim 2, further comprising:

a second driving member chamber for accommodating the driving member in a cylinder block; and a gas inlet having an opening for the second driving member chamber and communicated with said gas-liquid separation chamber.

5. The breather system according to claim 3, wherein said gas inlet is opened in a surface parallel to an operating plane of the driving member within the second driving member chamber.

6. The breather system according to claim 4, wherein said gas inlet is opened in a surface parallel to an operating plane of the driving member within the second driving member chamber.

7. The breather system according to claim 1, further comprising:

an oil flow back chamber provided at an upper end of said gas-liquid separation chamber and extending in a direction perpendicular to a plane formed by a cylinder axis and a crankshaft axis, and provided with an opening communicated with the driving member chamber.

8. A breather system of an engine having a cylinder head, a combustion chamber and a valve-operating device provided in the cylinder head, a driving member for driving the valve-operating device in synchronization with a crankshaft, and a driving member chamber for accommodating the driving member in the cylinder head, comprising:

a gas-liquid separation chamber provided, on an external side of the combustion chamber, with sandwiched between the combustion chamber and the gas-liquid separation chamber the driving member chamber, in the cylinder head, and being apart from the driving member chamber and communicated with a crank chamber, wherein said gas-liquid separation chamber separates oil component in blow-by gas guided into said chamber from the crank chamber, further comprising:

a second driving member chamber for accommodating the driving member in a cylinder block; and a gas inlet having an opening for the second driving member chamber and communicated with said gas-liquid separation chamber and wherein said gas inlet is opened in a surface parallel to an operating plane of the driving member within the second driving member chamber and said gas inlet includes an inclined surface extending from an opening of a side of said gas-liquid separation chamber to the opening of a side of the second driving member chamber toward the crank chamber.

9. A breather system of an engine having a cylinder head, a combustion chamber and a valve-operating device provided in the cylinder head, a driving member for driving the valve-operating device in synchronization with a crankshaft, and a driving member chamber for accommodating the driving member in the cylinder head, comprising:

a gas-liquid separation chamber provided, on an external side of the combustion chamber with sandwiched between the combustion chamber and the gas-liquid separation chamber the driving member chamber, in the cylinder head, and being apart from the driving member chamber and communicated with a crank chamber, wherein said gas-liquid separation chamber separates oil component in blow-by gas guided into said chamber from the crank chamber, said gas-liquid separation chamber is formed along a cylinder axis direction of the engine and further comprising:

a second driving member chamber for accommodating the driving member in a cylinder block; and a gas inlet having an opening for the second driving member chamber and communicated with said gas-liquid separation chamber, wherein said gas inlet is opened in a surface parallel to an operating plane of the driving member within the second driving member chamber and said gas inlet includes an inclined surface extending from an opening of a side of said gas-liquid separation chamber to the opening of a side of the second driving member chamber toward the crank chamber.

10. A breather system of an engine having a cylinder head, a combustion chamber and a valve-operating device provided in the cylinder head, a driving member for driving the valve-operating device in synchronization with a crankshaft, and a driving member chamber for accommodating the driving member in the cylinder head, comprising:

a gas-liquid separation chamber provided, on an external side of the combustion chamber, with sandwiched between the combustion chamber and the gas-liquid separation chamber the driving member chamber, in the cylinder head, and being apart from the driving member chamber and communicated with a crank chamber, wherein said gas-liquid separation chamber separates oil component in blow-by gas guided into said chamber from the crank chamber and further comprising:

an oil flow back chamber provided at an upper end of said gas-liquid separation chamber and extending in a direction perpendicular to a plane formed by a cylinder axis and a crankshaft axis, and provided with an opening communicated with the driving member chamber, wherein said oil flow back chamber includes a surface inclined from an outer wall thereof to said opening toward the crank chamber.

* * * * *